US006131541A

United States Patent [19]

Hasegawa et al.

[11] Patent Number: 6,131,541

[45] **Date of Patent: *Oct. 17, 2000**

[54] VARIABLE VALVE PERFORMANCE MECHANISM IN INTERNAL COMBUSTION ENGINE

[75] Inventors: Tadao Hasegawa, Toyota; Kiyoshi Sugimoto, Okazaki, both of Japan

[73] Assignee: Toyota Jidosha Kabushiki Kaisha, Aichi-Ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/893,731

[22] Filed: Jul. 11, 1997

[30] Foreign Application Priority Data

Jul. 12, 1996 [JP] Japan ..... 8-183370

[51] Int. Cl.[7] ..... F02D 13/02; F01L 1/34

[52] U.S. Cl. ..... 123/90.18; 123/90.17; 123/90.31

[58] Field of Search ..... 123/90.15, 90.16, 123/90.17, 90.18, 90.31; 74/567, 568 R; 464/1, 2, 160, 161

[56] References Cited

U.S. PATENT DOCUMENTS

| | | | |
|---|---|---|---|
| 4,570,581 | 2/1986 | Titolo | 123/90.18 |
| 4,794,893 | 1/1989 | Masuda et al. | 123/90.17 |
| 4,850,311 | 7/1989 | Sohn | 123/90.18 |
| 5,080,055 | 1/1992 | Komatsu et al. | 123/90.17 |
| 5,329,895 | 7/1994 | Nishida et al. | 123/90.18 |
| 5,381,764 | 1/1995 | Fukuma et al. | 123/90.18 |

FOREIGN PATENT DOCUMENTS

| | | |
|---|---|---|
| 116306 | 8/1984 | European Pat. Off. . |
| 108238 | 5/1994 | European Pat. Off. . |
| 55-87833 | 7/1980 | Japan . |
| 6-235305 | 8/1994 | Japan . |
| 7-139327 | 5/1995 | Japan . |
| 95-1061 | 1/1995 | Rep. of Korea . |

OTHER PUBLICATIONS

Andrea Titolo: "Die Variable Ventilsteuerung von FIAT ", Mopotortechnische Zeitschrift, vol. 47, No. 5, pp. 185–188, 1986.

*Primary Examiner*—Weilun Lo
*Attorney, Agent, or Firm*—Kenyon & Kenyon

[57] ABSTRACT

An apparatus for adjusting an engine valve. The valve is actuated by a cam on a camshaft. The cam has a cam surface that drives the valve by way of a follower. The radius of the cam surface varies in the axial direction in an angular section of the cam. A pulley surrounds one end of the camshaft. The camshaft is rotated relative to the pulley to change the valve timing and the camshaft is also moved axially to change the lift of the valve by changing the area of the cam surface engaged by the follower.

17 Claims, 4 Drawing Sheets

VARIABLE VALVE PERFORMANCE MECHANISM IN INTERNAL COMBUSTION ENGINE

BACKGROUND OF THE INVENTION

1. Field of the Invention

The present invention relates to a mechanism for varying performance of a set of intake valves or a set of exhaust valves in an engine. More particularly, the present invention pertains to a mechanism for varying valve timing and valve lift in an engine.

2. Description of the Related Art

A typical internal combustion engine includes a cylinder head provided with intake and exhaust valves. The intake valves selectively open and close intake passages connected to combustion chambers. Similarly, the exhaust valves selectively open and close exhaust passages connected to combustion chambers. In an engine having no mechanism for varying the performance of the valves, valve timing and valve lift of the intake and exhaust valves are constant at any given running state of the engine. The amount of intake air drawn into the combustion chambers and the amount of exhaust gas discharged from the combustion chambers directly correspond to the opening of a throttle valve and the engine speed.

In an engine equipped with a variable valve timing (VVT) mechanism, the valve timing of the intake valves, the exhaust valves, or both is varied. The VVT mechanism optimizes the valve timing (e.g. valve overlap) in accordance with the running state of the engine (engine load, engine speed and the like). This enhances the fuel economy and the power of the engine in wide range of different engine running states and reduces undesirable emissions.

Japanese Unexamined Patent Publication No. 6-234305 discloses an engine having a mechanism for varying the valve lift as well as a variable valve timing mechanism. The variable valve lift mechanism includes high speed cams used for a high engine speed and rocker arms that are actuated by the high speed cams. The mechanism also includes cams used for a low engine speed and rocker arms that are actuated by the low speed cams. Either the high speed cams and the high speed rocker arms or the low speed cams and the low speed rocker arms are selected in accordance with the running state of the engine. Switching the cams and the rocking arms changes the valve timing and valve lift. This further enhances the power and the fuel economy of the engine and reduces undesirable emissions.

However, the engine of this publication has the following problems:

(1) The variable valve timing mechanism and the variable valve lift mechanism both include an actuating system (a hydraulic circuit, a control circuit and the like). This complicates and enlarges the construction of the mechanisms. An engine having such mechanisms is larger and therefore requires more space in the engine compartment.

(2) The mechanisms are independently controlled. It is thus difficult to simultaneously obtain an optimal valve overlap and an optimal valve lift corresponding to a running state of the engine. This is because different actuating speeds of the mechanisms result in variations of changing amount of valve timing and valve lift.

(3) In the above described prior art variable valve lift mechanism, two pairs of cam and rocker arm are provided for a single valve. This complicates the construction of the mechanism.

SUMMARY OF THE INVENTION

Accordingly, it is an objective of the present invention to provide a variable valve performance mechanism including variable valve timing and variable valve lift mechanisms of a reduced size and a simplified construction.

It is another objective of the present invention to provide a variable valve performance mechanism that obtains an optimum valve timing and an optimum valve lift in accordance with a running state of the engine.

To achieve the above objective, the invention provides an apparatus for adjusting an engine valve mechanism. The valve mechanism includes a reciprocating valve having a lift, wherein the valve mechanism is actuated by a cam. The apparatus includes a camshaft for driving the cam, the camshaft having a first end, an engagement surface on the cam for slidably contacting the valve mechanism. The radius of the engagement surface of the cam varies in the axial direction in at least an angular section of the cam. A rotor is provided for driving the cam shaft. The rotor surrounds the camshaft at the first end. An actuator mechanism is provided for rotating the camshaft relative to the rotor to change the valve timing of the valve and for moving the camshaft in the axial direction to change the lift of the valve.

Other aspects and advantages of the invention will become apparent from the following description, taken in conjunction with the accompanying drawings, illustrating by way of example the principals of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

A first embodiment of the present invention will hereafter be described with reference to the drawings.

Figure 1:
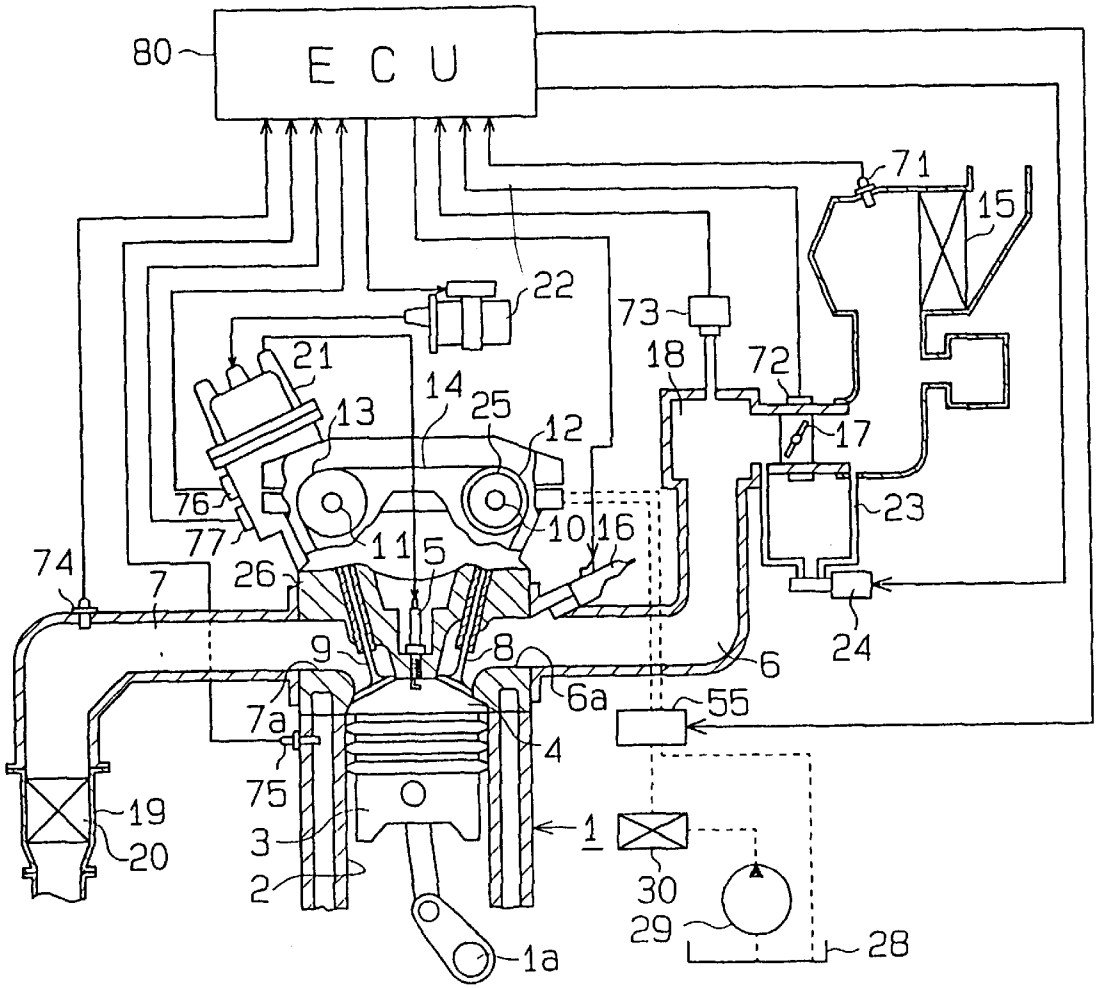
FIG. 1 is a cross-sectional view illustrating an engine system.

As shown in FIG. 1, an engine 1 has a plurality of cylinders 2 (only one is shown) defined therein. A piston 3 is reciprocally accommodated in each cylinder 2. The pistons 3 are connected to a crankshaft 1*a*. A cylinder head 26 is arranged in the upper portion of the engine 1 to cover each cylinder 2. A combustion chamber 4 is defined in each cylinder 2 between the cylinder head 26 and the piston 3. Ignition plugs 5 are provided for the combustion chambers 4 and are arranged along the cylinder head 26. Each plug 5 ignites the air-fuel mixture drawn into the corresponding combustion chamber 4. An intake port 6*a* and an exhaust port 7*a* are provided for each cylinder 2. Each intake port 6*a* is selectively opened and closed by an intake valve 8, while each exhaust port 7*a* is selectively opened and closed by an exhaust valve 9. An intake camshaft 10 and an exhaust camshaft 11 are rotatably supported on the cylinder head 26. The camshafts 10, 11 are provided with timing pulleys 12, 13 secured to the distal ends, respectively. The pulleys 12, 13 are connected to the crankshaft 1*a* by timing belt 14.

When the engine 1 is running, the torque of the crankshaft 1*a* is transmitted to the camshafts 10, 11 by the timing belt 14 and the timing pulleys 12, 13. The rotation of the camshafts 10, 11 actuates the valves 8, 9. The valves 8, 9 operate at a certain timing in synchronization with the rotation of the crankshaft 1*a*.

An air cleaner 15 is provided at the inlet of the intake passage 6 for cleaning atmospheric air drawn into the passage 6. A fuel injector 16 is provided in the vicinity of each intake port 6*a* for injecting fuel into the port 6*a*. When the engine 1 is running, air is drawn into the passage 6 through the air cleaner 15. The air is then mixed with the fuel injected from each injector 16. The air-fuel mixture is drawn into the combustion chamber 4 when the intake valve 8 is opened. The mixture in the combustion chamber 4 is combusted by sparking of the plug 5. This pushes the piston 3 downward to rotate the crankshaft 1*a*. The power of the engine 1 is thus generated. Opening of the exhaust valve 9 discharges the combusted gas, or exhaust gas, to the outside from the combustion chamber 4 through the exhaust passage 7.

A throttle valve 17 is provided in the intake passage 6. The valve 17 is operably connected to an acceleration pedal (not shown). The amount of air drawn into the intake passage 6, or the intake air amount, is controlled by changing the opening of the valve 17. A surge tank 18 is provided at the downstream side of the valve 17 for suppressing the fluctuations of the intake air. A temperature sensor 71 is provided in the vicinity of the air cleaner 15 for detecting the temperature of intake air and issuing signals corresponding the detected temperature.

A throttle sensor 72 is provided in the vicinity of the throttle valve 17 for detecting the opening of the valve 17 and issues signals corresponding to the detected opening. The sensor 72 issues an idling signal when the valve 17 is fully closed. The surge tank 18 is provided with a pressure sensor 73 that detects the pressure in the tank 18 and issues signals corresponding to the detected pressure.

The exhaust passage 7 is provided with a catalytic converter 19 including a three-way catalyst. The converter 19 cleans the exhaust gas. An oxygen sensor 74 is also provided in the exhaust passage 7 for detecting the concentration of oxygen in exhaust gas. The sensor 74 issues signals corresponding to the detected oxygen concentration. The engine 1 is provided with a coolant temperature sensor 75 that detects the temperature of the engine coolant and issues signals corresponding to the detected temperature.

A distributor 21 is mounted on the cylinder head 26 for distributing high voltage from the ignitor 22 to the plugs 5 thereby actuating the plugs 5. The firing timing of the plugs 5 is determined by the timing with which the ignitor 22 outputs the high voltage.

The distributor 21 incorporates a rotor (not shown) that rotates integrally with the camshaft 11. The rotation of the camshaft 11 is synchronized with the rotation of the crankshaft 1*a*. An engine speed sensor 76 provided in the distributor 21 detects the rotating speed of the crankshaft 1*a*, or the engine speed, based on the rotating speed of the rotor and outputs a pulse signal corresponding to the detected value. A cylinder distinguishing sensor 77 is provided in the distributor 21 to detect a reference position on the rotor that corresponds to a certain rotational phase of the crankshaft 1*a* as the rotor rotates. The distinguishing sensor 77 outputs a signal when detecting the reference position of the rotor. Two turns of the crankshaft 1*a* corresponds to four strokes of the engine 1. The engine speed sensor 76 outputs a pulse at every 30° of the crank angle (CA). The distinguishing sensor 77 outputs a pulse at every 360° CA.

In this embodiment, a bypass passage 23 provided in the intake passage 6 bypasses the throttle valve 17 and connects the upstream side of the valve 17 to the downstream side. An idle speed control valve (ISCV) 24 provided in the bypass passage 23 controls the flow rate of air passing through the passage 23. When the throttle valve 17 is fully closed, the ISCV 24 stabilizes the idling. When the engine 1 is idling, the ISCV 24 is controlled to adjust the amount of air drawn into the combustion chamber 4. The idling engine speed is controlled, accordingly.

In this embodiment, the camshaft 10 is provided with a variable valve performance mechanism 25 that changes the valve timing and the valve lift of the intake valves 8. The mechanism 25 is hydraulically operated.

Specifically, the mechanism 25 is actuated by an oil control mechanism illustrated in FIG. 1. The oil control mechanism includes an oil pan 28 for storing oil. The oil in the pan 28 is used for lubricating parts in the engine 1. An oil pump 29 draws the oil in the pan 28 and discharges the oil. The discharged oil is filtered by an oil filter 30. An oil control valve (OCV) 55 controls the pressure of oil supplied to the mechanism 25.

The detected values of the sensors are inputted to an electronic control unit (ECU) 80 as parameters. The ECU 80 estimates the running state of the engine 1 based on the inputted values. The ECU 80 controls the OCV 55 for obtaining a valve timing and valve lift suitable for the estimated running state of the engine 1.

The construction of the mechanism 25 and the OCV 55 will hereafter be described with reference to FIGS. 2 and 3.

The timing pulley 12 is provided with a cylindrical boss 38 and is rotatably supported by the cylinder head 26 and a bearing cap 27 of the engine 1. The camshaft 10 is rotatably supported by the pulley 12. The camshaft 10 has ring-like oil grooves 31*a*, 31*b*, 31*c* formed on its outer surface. The bearing cap 27 has oil passages 33, 34 defined therein. The passages 33, 34 are communicated with the grooves 31*a*, 31*b* by arcuate passages 45*a*, 45*b* formed in the boss 38, respectively.

When the engine 1 is running, the oil pump 29 is actuated and draws the oil from the oil pan 28. The pump 29 then discharges the oil to the OCV 55 through the oil filter 30. The OCV 55 selectively supplies the oil to the passages 33 and 34.

The pulley 12 is substantially shaped like a disk and is supported on the camshaft 10. The pulley 12 rotates with respect to the camshaft 10. The pulley 12 has a plurality of teeth 37. The belt 14 is engaged with the teeth 37.

The cover 35 has a flange 39 formed at the open end. The cover 35 is secured to the pulley 12 by screwing a plurality of bolts 14 to the front end face of the pulley 12 through the flange 39. The cover 35 has a hole 40 formed in its front end face. A lid 43 is detachably fitted to the hole 40. The cover 35 has teeth 35*a* formed on its inner wall. The teeth 35*a* form helical splines.

A ring gear 48 and a spring 42 are accommodated in a space 44 defined by the pulley 12 and the cover 35. The ring gear 48 is secured to the front end of the camshaft 10 by a hollow bolt 46 and a pin 47. The spring 42 is located between the ring gear 48 and the pulley 12. The ring gear 48 moves along the axis of the camshaft 10. The spring 42 urges the gear 48 away from the pulley 12.

The ring gear 48 is provided with a plurality of teeth 48*a* that form helical splines. The cooperation of the teeth 48*a* of the ring gear 48 and the teeth 35*a* of the cover 35 allows the gear 48 to be coupled to the cover 35. The movement of the ring gear 48 along its axis causes a relative rotation between the gear 48 and the cover 35.

The pulley 12 rotates synchronously with the crankshaft 1*a*. The rotation of the pulley 12 is transmitted to the camshaft 10 by the cover 35 and the ring gear 48. Accordingly the camshaft 10 rotates synchronously with the pulley 12.

The camshaft 10 is provided with a plurality of cams C for actuating the intake valves 8. The cams C have a substantially eggshaped cross-section. A cup-shaped valve lifter 8*a* is secured to the intake valve 8 with the open end facing toward the valve 8. A shoe 8*b* is placed between the lifter 8*a* and the cam C. A valve spring 65 is placed between the lifter 8*a* and the cylinder head 26. The spring 65 urges the shoe 8*b* upward thereby causing the shoe 8*b* to constantly contact the cam surface C1 of the cam C.

Rotation of the camshaft 10 causes each intake valve 8 to reciprocates in accordance with the shape of the cam surface C1 contacting the lifter 8*a*. The shoe 8*b*, which is placed between the lifter 8*a* and the cam surface C1, includes a flat portion 8*c* contacting the cam surface C1 and a spherical portion 8*d* contacting the lifter 8*a*. Engagement between the cam nose and the shoe 8*b* maximizes the opening of the intake valve 8. In the drawings, the top of the cam C is formed parallel to the axis of the shaft 10, while the bottom (cam nose) is tapered and has a predetermined gradient. Specifically, the cam surface C1 is formed such that its radius is shorter toward the proximal end of the shaft 10 (rightward as viewed in FIGS. 2 and 3). In other words, the profile of the cam C changes at a predetermined rate about the axis of the shaft 10. The gradient of the cam surface C1 is greatest at the cam nose. The gradient decreases toward the opposite side of the cam. The shoe 8*b* rotates with respect to the lifter in accordance with the change in the gradient of the cam surface C1.

The ring gear 48 divides the space 44 into first and second oil chambers 49, 50. The first oil chamber 49 is defined by the ring gear 48 and the cover 35, while the second oil chamber 50 is defined by the ring gear 48 and the pulley 12.

The camshaft 10 has an oil passage 51 axially formed therein for supplying oil pressure to the fist oil chamber 49. The distal end of the oil passage 51 is communicated with the first oil chamber 49 by the hole 46*a* formed in the hollow bolt 46. The proximal end of the passage 51 is communicated with the oil groove 31*a* formed on the periphery of the camshaft 10.

The camshaft 10 also has another oil passage 53 formed therein parallel to the passage 51 for supplying oil pressure to the second oil chamber 50. An oil hole 54 is formed in the boss 38 of the pulley 12 for communicating the second oil chamber 50 with the oil passage 53.

The pressures of oil in the chambers 49, 50 are adjusted by duty controlling the OCV 55. The OCV 55 includes a casing 55, a spool 62 housed in the casing 56, a spring 64 for urging the spool 62 and an electromagnetic solenoid 63. The casing 56 has first to fifth ports 57, 58, 59, 60, 61. The first port 57 is connected to the oil passage 33 and the second port 58 is connected to the oil passage 34. The third and fourth ports 59, 60 are connected to the oil pan 28 (see FIG. 1) and the fifth port 61 is connected to the oil pump 29 via the oil filter 30 (see FIG. 1).

The spool 62 has four cylindrical valve body 62*a*. The spool 62 reciprocates along its axis. The solenoid 63, which is attached to the casing 56, moves the spool 62 between the a first position (shown in FIG. 2) and a second position (shown in FIG. 3).

The first position refers to a position of the spool 62 when it is rightmost (as viewed in FIGS. 2 and 3) with respect to the casing 56. The spool 62 has the minimum stroke at the first position. The second position refers to a position of the spool 62 when it is leftmost (as viewed in FIGS. 2 and 3) with respect to the casing 56. The spool 62 has the maximum stroke at the second position. The spring 64 in the casing 56 urges the spool 62 toward the first position.

Figure 2:
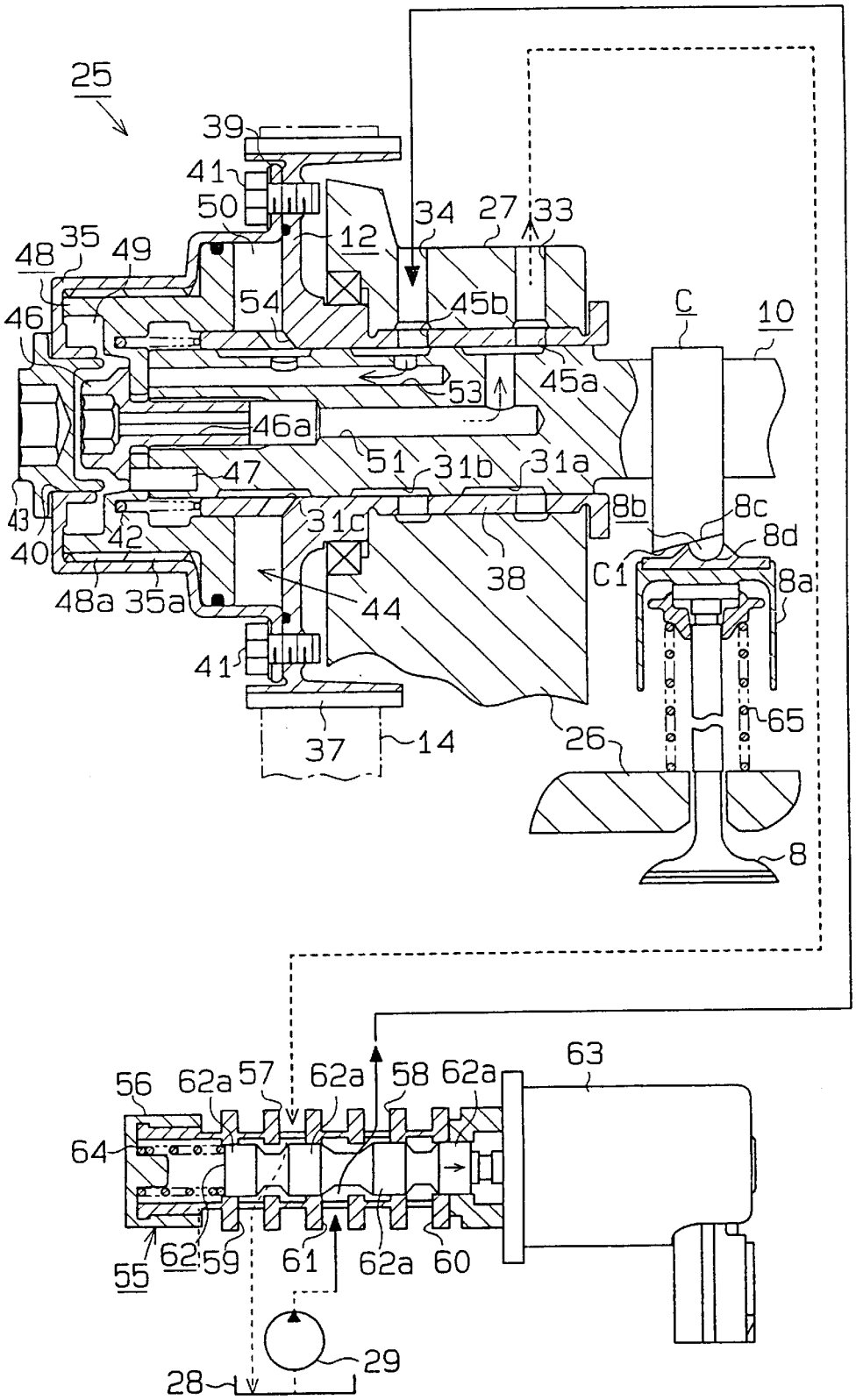
FIG. 2 is a cross-sectional view illustrating a variable valve performance mechanism and an oil control valve.

When in the first position as in FIG. 2, the spool 62 communicates the fourth port 61 with the second port 58 and communicates the first port 57 with the third port 59. Therefore, oil from the pump 29 is supplied to the second oil chamber 50 through the passages 34, 53 increasing the pressure in the chamber 50, while oil in the first oil chamber 49 is drained through the passages 51, 33. The increase of the pressure in the chamber 50 moves the ring gear 48 leftward (in FIG. 2) against the oil in the first oil chamber 49. This rotates the ring gear 48 with respect to the cover 35 and the pulley 12. The rotational phase of the gear 48 is retarded with respect to the pulley 12. As the ring gear 48 is moved leftward, the camshaft 10 is also moved leftward and the rotational phase of the shaft 10 is also retarded with respect to that of the pulley 12. As a result, the valve timing of the intake valve 8 is retarded with respect to the rotational phase of the crankshaft 1*a*.

In this manner, increasing the pressure of oil supplied to the second oil chamber 50 moves the ring gear 48 to the position closest to the cover 35 as illustrated in FIG. 2. In this state, the valve timing of the intake valve 8 is most retarded and the overlap of the intake valves 8 and the exhaust valves 9 is minimized. In this embodiment, the valve overlap becomes zero when the valve timing of the intake valve 8 is most delayed.

Figure 4:
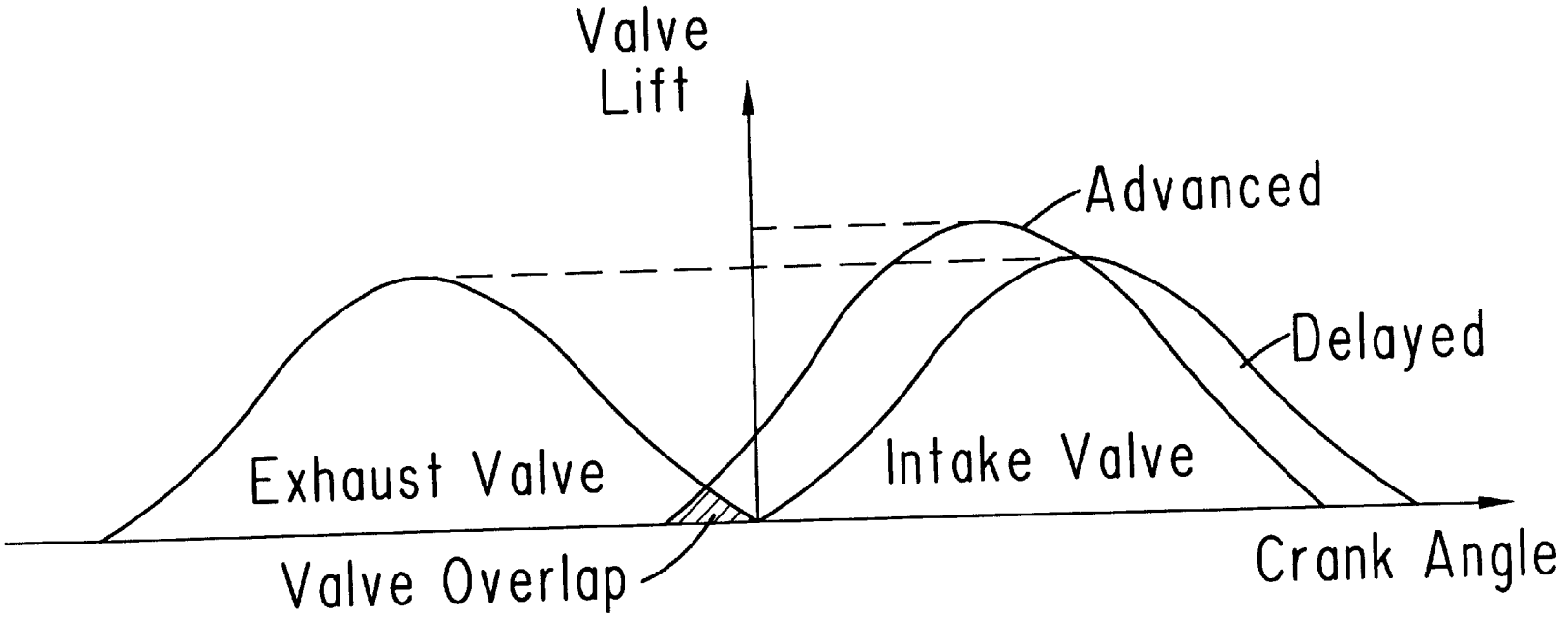
FIG. 4 is a chart explaining changes of valve overlap and valve lift.

The movement of the camshaft 10 causes the cam C to move therewith. The cam C contacts the shoe 8*b* at the small radius portion. In this state, the distance between the axis of the camshaft 10 and the shoe 8*b* is minimized. Accordingly, the valve lift of the intake valve 8 is minimum. As shown in FIG. 4, when the valve overlap is minimum, the valve lift of the intake valve 8 is also minimum. The minimum valve lift of the intake valve 8 is equal to the valve lift of the exhaust valve 9. Further, the valve overlap of the valves 8, 9 is zero. The relationship between the valve timing and valve lift of the intake valve 8 is optimized for the running condition of the engine 1.

Figure 3:
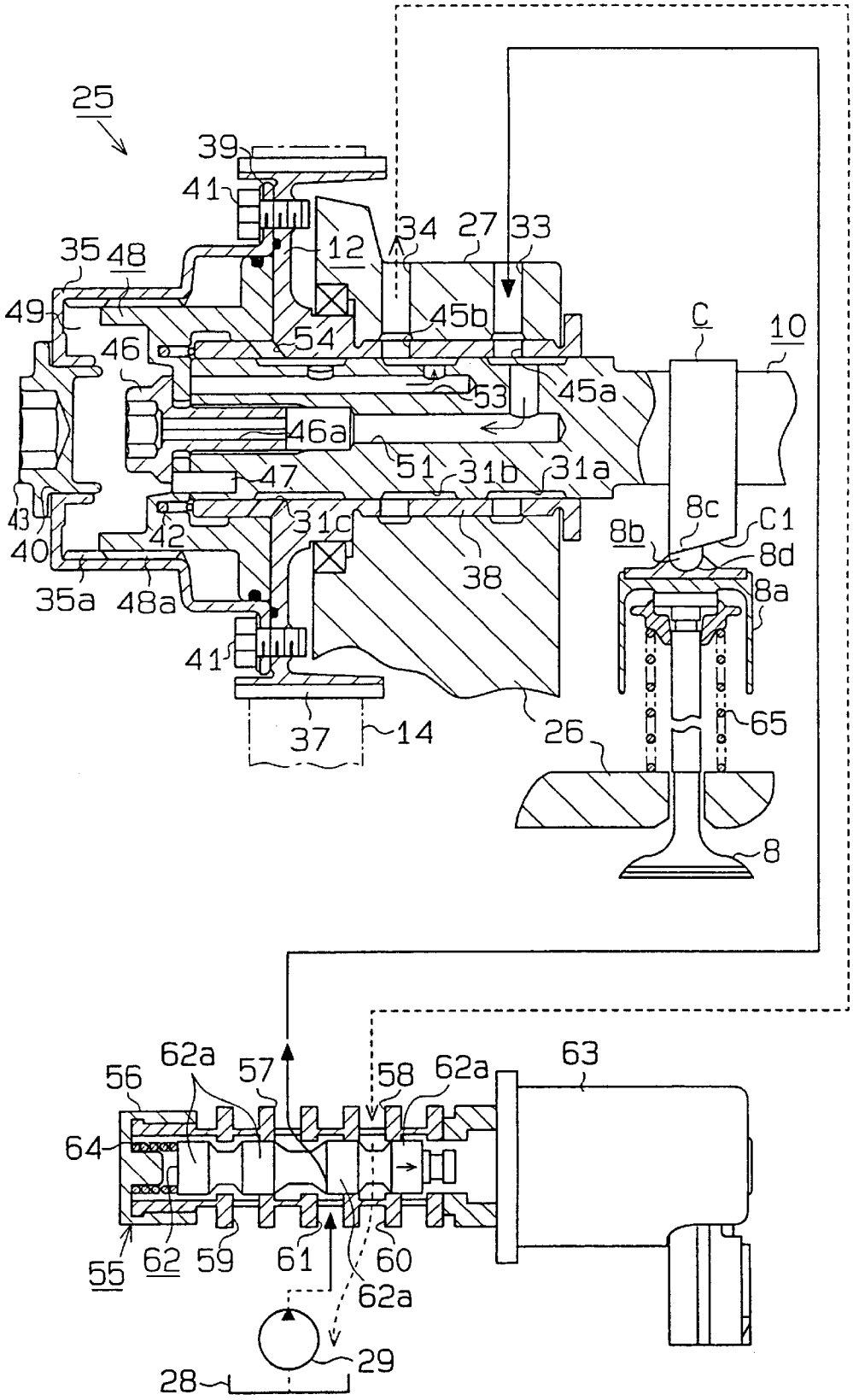
FIG. 3 is a cross-sectional view illustrating a variable valve performance mechanism and an oil control valve.

When the spool 62 is moved to the second position against the force of the spring 64 as shown in FIG. 3, the spool 62 communicates the fourth port 61 with the first port 57 and communicates the second port 58 with the fifth port 60. Therefore, oil from the pump 29 is supplied to the first oil chamber 49 through the passages 33, 51 increasing the pressure in the chamber 49, while oil in the second oil chamber 50 is drained through the passages 53, 34. The increase of the pressure in the chamber 49 moves the ring gear 48 rightward (in FIG. 3) against the oil in the second oil chamber 50. This rotates the ring gear 48 with respect to the cover 35 and the pulley 12. The rotational phase of the gear 48 is advanced with respect to the pulley 12. As the ring gear 48 is moved rightward, the camshaft 10 is also moved rightward and the rotational phase of the shaft 10 is also advanced with respect to that of the pulley 12. As a result, the valve timing of the intake valve 8 is advanced with respect to the rotational phase of the crankshaft 1*a*.

In this manner, increasing the pressure of oil supplied to the first oil chamber 49 moves the ring gear 48 to the position closest to the pulley 12 as illustrated in FIG. 3. In this state, the valve timing of the intake valve 8 is most advanced and the overlap of the intake valve 8 and the exhaust valve 9 is maximized.

The movement of the camshaft 10 causes the cam C to move therewith. This changes the relative position of the cam C with the shoe 8*b*. That is, the part of the cam surface C1 contacting the shoe 8*b* is shifted along the axis of the camshaft 10. Specifically, the cam C contacts the shoe 8*b* at the large radius portion. In this state, the distance between the axis of the camshaft 10 and the shoe 8*b* is maximum. This maximizes the valve lift of the intake valve 8. As shown in FIG. 4, when the valve overlap is maximum, the valve lift of the intake valve 8 is also maximized. The maximum valve lift of the intake valve 8 is greater than the valve lift of the exhaust valve 9. Further, the valve overlap of the valves 8, 9 is also maximized. The relationship between the valve timing and valve lift of the intake valve 8 is optimized for the running condition of the engine 1.

The opening area of the ports 57 to 61 is controlled by locating the spool 62 at an arbitrary position between the first and second positions. Accordingly, oil pressure supplied to the oil chambers 49, 50 is controlled. This controls the speed of axial movement of the ring gear 48 and the camshaft 10. The speed of valve timing change and the valve lift change is controlled, accordingly. When the spool 62 is located at the midpoint between the first and second positions, the first and second ports 57, 58 are closed. Therefore, the supply of oil pressure to the oil chambers 49, 50 is stopped. The valve timing and the valve lift of the intake valves 8 is maintained at this state.

As described above, the valve overlap and the valve lift are controlled by the common drive source (the oil pump 29), the common controller (the ECU 80) and the common mechanism 25. Unlike the prior art engine, which has a variable valve timing mechanism and a variable valve lift mechanism, the mechanism 25 has a simplified construction and a reduced size. This lowers the manufacturing cost of the mechanism 25.

The valve timing and the valve lift are simultaneously changed. This facilitates the optimization of the valve overlap and valve lift for the running state of the engine at a given moment. The power and the fuel economy of the engine 1 are enhanced accordingly and undesirable emissions are reduced.

The cam nose of the cam C is tapered. Thus, changing the relative position of the cam C with the shoe 8*b* along the axis of the camshaft 10 continuously changes the valve lift of the intake valves 8. Therefore, changing the valve lift does not cause the power of the engine 1 to abruptly change. This improves the engine performance. Further, the valve timing and the valve lift of each valve 8 are adjusted by a single cam C. This simplifies the mechanism 25.

Although only one embodiment of the present invention has been described herein, it should be apparent to those skilled in the art that the present invention may be embodied in many other specific forms without departing from the spirit or scope of the invention. Particularly, it should be understood that the invention may be embodied in the following forms.

(1) The mechanism 25 may be provided on the exhaust camshaft 11 for changing the valve timing and the valve lift of the exhaust valves 9. Further, both camshafts 10, 11 may be provided with the mechanism 25.

(2) In the preferred embodiment, the cam C directly actuates the intake valve 8 without a rocker arm. However, a rocker arm may be placed between the cam C and the intake valve 8.

(3) In the preferred embodiment, the cam C is provided with the gradient that increases the valve lift as the valve overlap increases. However, the cam C may be provided with a gradient that decreases the valve lift as the valve overlap increases. Specifically, the gradient of the cam surface C1 may be formed such that the distance between the axis of the camshaft 10 and the cam surface C1 increases toward the proximal end of the camshaft 10.

Therefore, the present examples and embodiments are to be considered as illustrative and not restrictive and the invention is not to be limited to the details given herein, but may be modified within the scope and equivalence of the appended claims.

What is claimed is:

1. An apparatus for adjusting an engine valve mechanism, the valve mechanism including a reciprocating valve having a lift, wherein the valve mechanism is actuated by a cam, the apparatus comprising:

a camshaft for driving the cam, the camshaft having a first end;

an engagement surface on the cam for slidably contacting the valve mechanism, wherein the radius of the engagement surface of the cam varies in the axial direction of the camshaft in at least an angular section of the cam;

a rotor for driving the camshaft, wherein the rotor surrounds the camshaft at the first end;

an actuator mechanism for rotating the camshaft relative to the rotor to change the valve timing of the valve and for moving the camshaft in the axial direction to change the lift of the valve; and a ring gear located at the first end of the camshaft, wherein the ring gear is connected to the rotor, wherein the rotor defines a space near the first end of the camshaft, wherein the ring gear divides the space into a first chamber receiving a hydraulic fluid pressure to move the ring gear in a first direction and a second chamber receiving a hydraulic fluid pressure to move the ring gear in a second direction.

2. The apparatus according to claim 1, wherein the valve mechanism engages a contact area of the engagement surface, and wherein the contact area is changed to change the valve lift of the valve when the camshaft is moved in axial direction by the actuator mechanism.

3. The apparatus according to claim 1, wherein the actuator mechanism is constructed to change the valve timing and valve lift of the valve simultaneously.

4. The apparatus according to claim 1, wherein the cam includes a nose for opening the valve, and wherein the nose is within the angular section.

5. The apparatus according to claim 4, wherein the engagement surface is sloped in the axial direction at the nose.

6. The apparatus according to claim 5, wherein the valve mechanism includes a shoe that contacts the cam and a seat for pivotally supporting the shoe, wherein the shoe includes a planar surface, wherein the planar surface and the engagement surface of the cam make line contact with one another.

7. The apparatus according to claim 6, wherein the shoe is supported by the seat such that the shoe pivots with respect to the valve mechanism as a result of the contact between the planar surface and the engagement surface when the cam rotates.

8. The apparatus according to claim 6, wherein a shoe surface is supported by the valve mechanism in the seat such that the planar surface is angled with respect to the axis of the camshaft when the nose of the cam contacts the shoe.

9. The apparatus according to claim 6, wherein the engagement surface is wider than the planar surface as measured in the axial direction of the camshaft.

10. The apparatus according to claim 1, further comprising a second camshaft for driving a second cam, wherein the second cam drives a second valve, wherein a valve overlap between the first valve and the second valve is increased as the first camshaft is moved to increased to the lift of the first valve.

11. The apparatus according to claim 1, further comprising:

inner teeth fixed to the rotor;

outer teeth fixed to the ring gear, wherein the inner teeth of the rotor and the outer teeth of the ring gear form a helical spline coupling.

12. The apparatus according to claim 1, wherein the space is further defined by the camshaft.

13. The apparatus according to claim 1, further comprising a spring for urging the ring gear in the second direction.

14. The apparatus according to claim 13, wherein the actuator mechanism is powered by hydraulic fluid pressure supplied selectively to the first and second chambers.

15. The apparatus according to claim 14, further comprising a hydraulic control unit for controlling the flow of fluid supplied to the first and second chambers.

16. The apparatus according to claim 1, wherein the engine has a crankshaft, the apparatus further comprising a transmission means for transmitting engine power from the crankshaft to the rotor, and wherein the rotor is rotated in fixed synchronism with the crankshaft.

17. An apparatus for adjusting an engine valve mechanism, the valve mechanism including a reciprocating valve having a lift, the valve mechanism being actuated by a cam, the apparatus comprising:

a first camshaft for driving the first cam, the first camshaft having a first end;

a second camshaft for driving a second cam, wherein the second cam drives a second valve;

an engagement surface on the first cam for slidably contacting the valve mechanism, wherein the radius of the engagement surface of the cam varies in the axial direction of the first camshaft in at least an angular section of the first cam;

a ring gear connected to the first end of the shaft, wherein the ring gear has outer teeth formed thereon;

a rotor for driving the camshaft, the rotor having inner teeth formed thereon, wherein the rotor surrounds the first camshaft at the first end, and wherein the outer teeth and the inner teeth form a helical spline coupling, wherein the rotor defines a space into a first chamber receiving a hydraulic fluid pressure to move the ring gear in a first direction and a second chamber receiving a hydraulic pressure to move the ring gear in a second direction; and an actuator mechanism for rotating the first camshaft relative to the rotor to change the valve timing of the first valve and for moving the first camshaft in the axial direction to change the lift of the valve;

wherein a valve overlap between the first valve and second valve is increased as the first camshaft is moved to increase the lift first valve.

* * * * *

UNITED STATES PATENT AND TRADEMARK OFFICE

CERTIFICATE OF CORRECTION

PATENT NO. : 6,131,541
DATED : October 17, 2000
INVENTOR(S) : Tadao Hasegawa et al.

It is certified that error appears in the above-identified patent and that said Letters Patent is hereby corrected as shown below:

Column 9,
Line 10, change "increased" to -- increase --.

Column 10,
Line 20, after "space" insert -- near the first end of the first cam-shaft, and wherein the ring gear divides the space --.

Signed and Sealed this

Fourth Day of December, 2001

*Attest:*

Nicholas P. Godici

NICHOLAS P. GODICI
*Acting Director of the United States Patent and Trademark Office*

*Attesting Officer*